US009302163B1

(12) United States Patent
Maldonado

(10) Patent No.: US 9,302,163 B1
(45) **Date of Patent: *Apr. 5, 2016**

(54) GOLF TEE

(71) Applicant: Lucio Maldonado, Downey, CA (US)

(72) Inventor: Lucio Maldonado, Downey, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/514,792

(22) Filed: Oct. 15, 2014

Related U.S. Application Data

(60) Provisional application No. 61/892,972, filed on Oct. 18, 2013.

(51) Int. Cl.
*A63B 57/00* (2015.01)
*A63B 69/36* (2006.01)

(52) U.S. Cl.
CPC ..... *A63B 57/0018* (2013.01); *A63B 69/3623* (2013.01)

(58) Field of Classification Search
CPC ..... A63B 57/00; A63B 57/0018; A63B 57/10–57/19; A63B 69/3623
USPC ..... 473/387–403, 417, 420; D21/717, 716, D21/715
See application file for complete search history.

(56) References Cited

U.S. PATENT DOCUMENTS 1,335,005 A * 3/1920 Mahony ..... 206/315.1
1,551,207 A * 8/1925 Nial et al. ..... 473/400
1,599,310 A * 9/1926 Wiley ..... 473/388
1,604,926 A * 10/1926 MacDonald ..... 473/389
1,635,376 A * 7/1927 McIlvaine ..... 473/388
1,638,527 A * 8/1927 Clausing ..... 473/402
1,692,233 A * 11/1928 Patten ..... 473/390
1,936,625 A * 11/1933 Goldman ..... 473/398
2,072,688 A * 3/1937 Rose ..... 473/388
D158,235 S * 4/1950 Van Horne ..... D21/782
D159,558 S * 8/1950 Sundell ..... D21/782
D172,327 S * 6/1954 Ankney ..... D21/717
2,930,615 A * 3/1960 Cowan ..... 473/388
3,697,082 A * 10/1972 Di Laura et al. ..... 473/388
D337,364 S * 7/1993 Piper et al. ..... D21/717
D346,416 S * 4/1994 Cassidy ..... D21/717
D368,503 S * 4/1996 Bess ..... D21/717
D376,830 S * 12/1996 Bess ..... D21/717
D382,928 S * 8/1997 Bess ..... D21/717
D533,240 S * 12/2006 Sovay ..... D21/717
7,448,967 B1 * 11/2008 Panneri et al. ..... 473/387
D657,431 S * 4/2012 Chilton ..... D21/717
D722,120 S * 2/2015 Russell ..... D21/717
D725,727 S * 3/2015 Maldonado ..... D21/717

FOREIGN PATENT DOCUMENTS

CA 2263812 A1 * 8/2000

* cited by examiner

*Primary Examiner* — Steven Wong
(74) *Attorney, Agent, or Firm* — Eric Karich; Karich & Associates

(57) ABSTRACT

A golf tee has a tee body that forms at least three ball support points that are each spaced from a center point of the tee body. The tee body further has at least three ground contact points that are each positioned between two of the ball support points for supporting the tee body and the golf ball above the ground surface. The tee body is constructed such that the ball support points are spaced from the ground contact points such that a golf ball is supported above the ground surface.

3 Claims, 2 Drawing Sheets

GOLF TEE

CROSS-REFERENCE TO RELATED APPLICATIONS

This application for a utility patent claims the benefit of U.S. Provisional Application No. 61/892,972, filed Oct. 18, 2013.

BACKGROUND OF THE INVENTION

1. Field of the Invention

This invention relates generally to golf tees, and more particularly to a golf tee that is adapted for use on a golf mat.

2. Description of Related Art

Conventional golf tees are inserted into the ground when hitting off of grass, for supporting the golf ball off of the ground. Sometimes, however, golfers sometimes hit golf balls off of a mat, particularly when practicing drives at a driving range. When hitting off of a mat, traditional golf tees can't be used.

To provide a tee at a driving range, it is common for such ranges to include rubber tubes that stick upwardly from the mat, so that the tube can be used to support the golf ball. However, these tubes are best adapted for hitting with a driver, and are not as well suited for practicing with irons. Furthermore, the tubes are fixed, and cannot be moved, and they also tend to vary in height. It is important that golfers practice their swing so that they always strike at the same height.

It is helpful, however, to lift the golf ball at least somewhat off the mat (1-30 mm being the most preferred range of lift), so that the golfer does not inadvertently strike the mat, which can cause injury to the golfer's hands, arms, and/or shoulders.

The prior art does not teach a tee that is suitable for hitting balls off of mats, without being inserted into the ground, and that hold the ball at a consistent height, and which may be moved about the mat as desired. The present invention fulfills these needs and provides further advantages as described in the following summary.

SUMMARY OF THE INVENTION

The present invention teaches certain benefits in construction and use which give rise to the objectives described below.

The present invention provides a golf tee for holding a golf ball above a ground surface. The golf tee comprises a tee body that forms at least three ball support points that are each spaced from a center point of the tee body. The tee body further has at least three ground contact points that are each positioned between two of the ball support points for supporting the tee body and the golf ball above the ground surface. The tee body is constructed such that the ball support points are spaced from the ground contact points such that the golf ball is supported above the ground surface.

A primary objective of the present invention is to provide a golf tee having advantages not taught by the prior art.

Another objective is to provide a golf tee that is suitable for hitting balls off of mats with irons, that hold the ball at a consistent height, and which may be moved about the mat as desired.

A further objective is to provide a golf tee that is inexpensive to manufacture and easy to use. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a golf tee 10 for holding a golf ball 12. The golf tee 10 that is most suitable for holding the golf ball 12 off of a ground surface 14, such as a mat, in a manner suitable for hitting the ball 12 with a golf club, typically an iron or other form of non-driver club, although drivers may also be used if desired. The golf tee 10 holds the golf ball 12 at a golf ball height H1, as defined below, which is a consistent height above the ground surface 14. Furthermore, the golf tee 10 does not need to be inserted into the ground, and may be readily moved about the ground surface 14, as desired.

Figure 1:
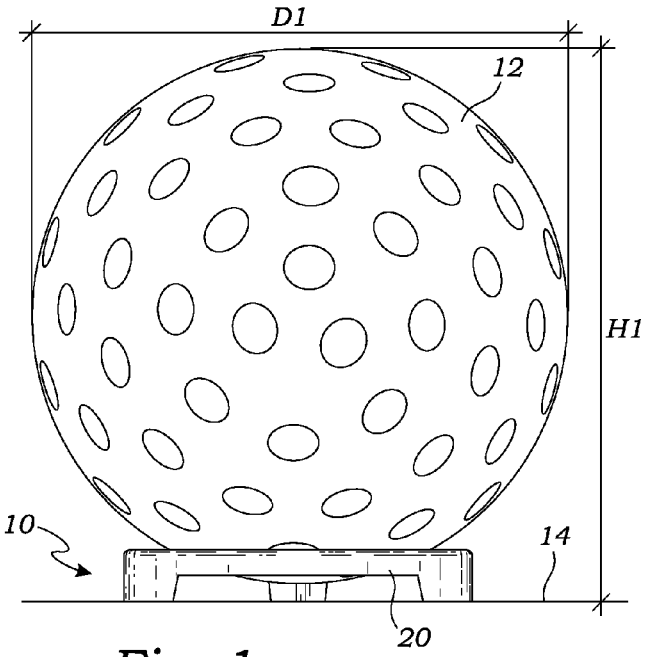
FIG. 1 is a side elevation view of one embodiment of a golf tee, illustrating a golf ball in position upon the golf tee.
Figure 2:
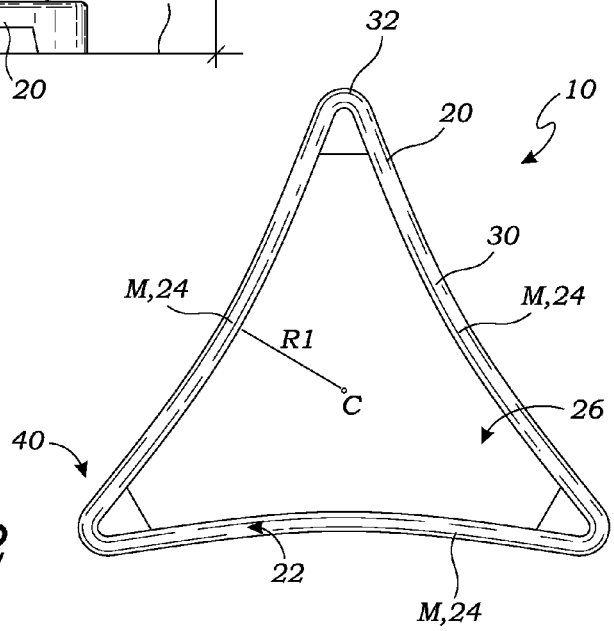
FIG. 2 is a top plan view of the golf tee.
Figure 3:
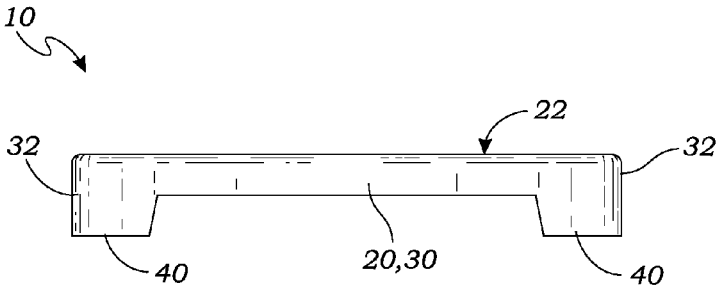
FIG. 3 is a side elevation view thereof.
Figure 4:
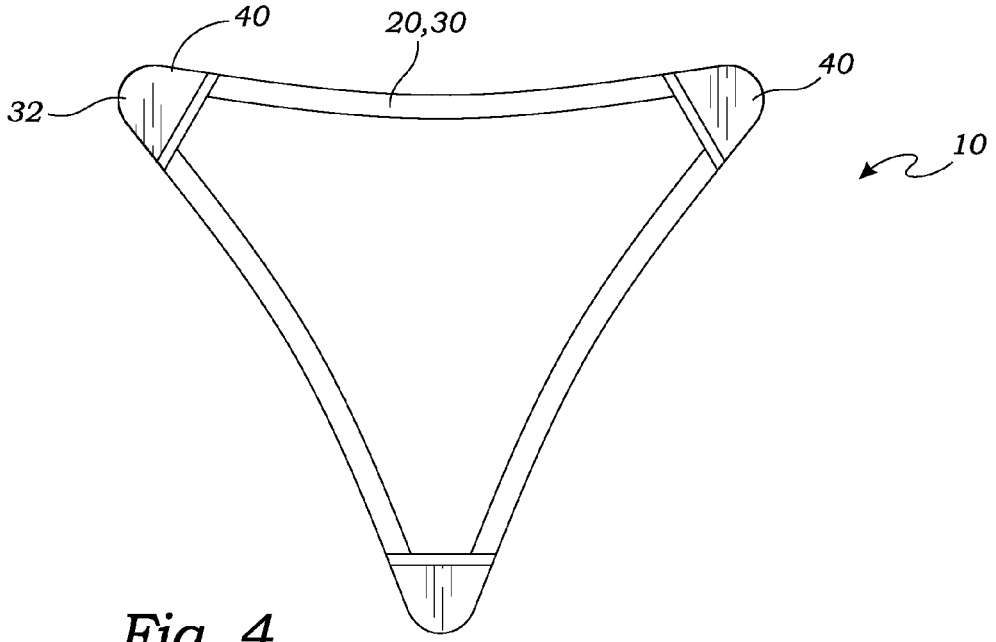
FIG. 4 is a bottom plan view thereof.
Figure 5:
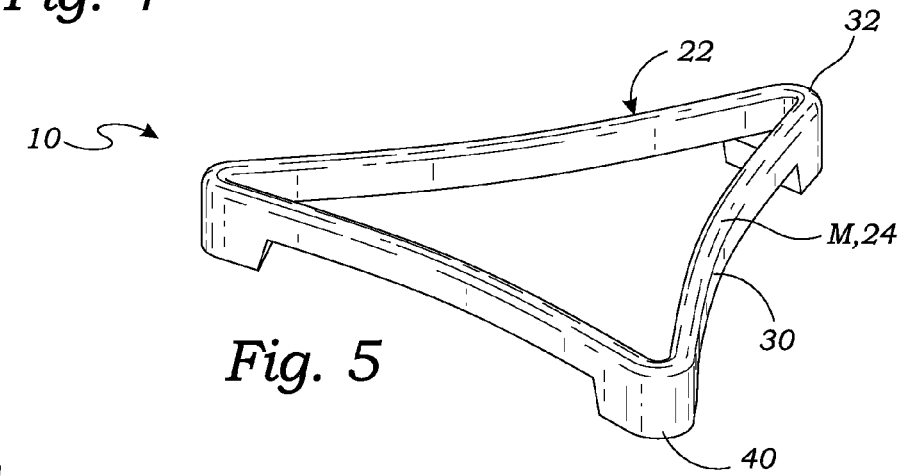
FIG. 5 is a top perspective view thereof.
Figure 6:
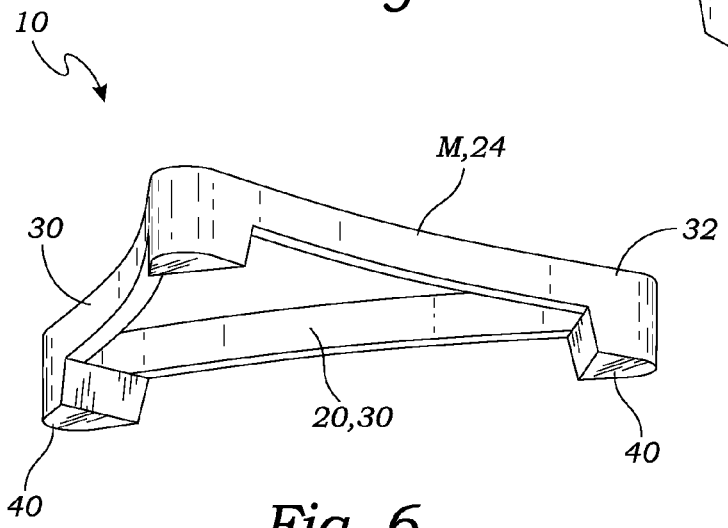
FIG. 6 is a bottom perspective view of the golf tee.

FIG. 1 is a side elevation view of a golf tee 10 illustrating the golf ball 12 in position upon the golf tee 10. As shown in FIG. 1, the golf tee 10 is constructed to hold the golf ball 12 in place for a user, while providing a minimum of deflection to the golf ball 12 when struck. This is accomplished by having the golf ball 12 sit as shallowly in the golf tee 10 as possible, while still providing a stable tee to capture the golf ball 12. The golf ball 12 has a golf ball diameter D1, and the golf ball height, H1, is defined as the vertical distance from the top of the golf ball 12 to the ground surface 14 (D1 plus the height added by the golf tee 10). The ball height H1 should be about 1-30 mm greater than the ball diameter D1, typically 2-10 mm greater for use with irons, although greater heights may also be selected, particularly in embodiments that are more adapted for use with drivers. For purposes of this application, the term "about" is hereby defined to mean +/−10%. FIG. 2 is a top plan view of the golf tee 10, FIG. 3 is a side elevation view thereof, FIG. 4 is a bottom plan thereof, FIG. 5 is an top perspective view thereof, and FIG. 6 is a bottom perspective view thereof. As shown in FIGS. 1-6, the golf tee 10 of this embodiment has a tee body 20 that is suitable for supporting the golf ball 12 above the ground surface 14. The tee body 20 includes at least three ball support points 24 for contacting the golf ball 12, and at least three ground contact points 40 for supporting the golf tee 10 on the ground surface 14. At least three of each of required to provide the required support plane; however, a larger number may be included if desired.

The tee body 20 is generally annular in construction, so that the tee body 20 defines an interior space 26 that is shaped to receive a portion of the golf ball 12, supported on each side by one of the ball support points. Likewise, the ground contact points 40 are spaced around the interior space 26. In this embodiment, the ground contact points 40 are positioned between the ball support points 24 (in this case equidistant to each of the adjacent ball support points 24), although in alternative embodiments they may have different relative positions.

The tee body 20 defines a center C that is approximately equidistant to each of the ball support points 24. The distance from the center C and each of the ball support points 24 provides an inscribed radius R1, and forms the interior space

26 where the golf ball 12 will be seated within the golf tee 10. In the present embodiment, the dimensions of the golf tee 10 are chosen such that the inscribed radius R1 is between about 4.0 mm and 6.0 mm, in this case about 5.0 mm, though in other embodiments this may be varied by one skilled in the art.

In the present embodiment, the tee body 20 is a triangular body that includes three sides 30 connected by apexes 32 that together define the interior space 26. The triangular body 20 provides a top surface 22 of the golf tee 10. The sides 30 each have a midpoint M, which provides one of the ball support points 24, the point of contact between the golf tee 10 and the golf ball 12 when it is operably positioned on the golf tee 10. The distance between any of the midpoints M and the center C defines the inscribed radius R1 described above. The triangular construction of the present embodiment serves to minimize the number and area of the contact points between the golf ball 12 and the golf tee 10.

As shown in FIGS. 3-6, the golf tee 10 may further include legs 40 extending outwardly from the apexes 32, generally perpendicular to the plane of the triangular body tee 10. The height of the legs 40 may be varied according to one skilled in the art to place the golf ball 12 at the height H1 that is best suited for the practice of golf. While FIGS. 2-6 illustrates one embodiment of the legs 40, those skilled in the art may devise alternative embodiments, and these alternative or equivalent are considered within the scope of the present invention.

The golf tee 10 may be made of any suitable material known to one skilled in the art, including plastic, rubber, environmentally-friendly materials such as biodegradable plastics, wood, or any other material desired (e.g., aluminum, steel, cork, etc.). While FIGS. 2-6 illustrates one embodiment of the golf tee 10, those skilled in the art may devise alternative embodiments, and these alternative or equivalent are considered within the scope of the present invention. While the present golf tee 10 is triangular in shape, in other embodiments alternate shapes are possible, such as square, pentagonal, hexagonal, or any shape suitable for providing an inner space to stably hold the golf ball 12. In such embodiments, the numbers of sides, apexes, legs, and spaces formed by the plurality of sides needed to describe the shape of the embodiment in question may be consistent with such constructions and considered equivalent to the embodiment shown herein.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A golf tee for holding a golf ball above a ground surface, the golf tee comprising:

a tee body that includes three sides connected by three apexes to form a generally triangular shape;

wherein midpoints of each of the three sides form ball support points for supporting the golf ball, while the tee body does not contact the golf ball except for at the midpoints of each of the three sides at these ball support points;

a leg that extends downwardly from each of the apexes of the triangular body to form a ground contact point, such that the tee body is supported above the ground surface upon the ground contact points.

2. The golf tee of claim 1, wherein the midpoints of the three sides are each spaced about 5 mm from a center of the tee body.

3. A method for hitting a golf ball off of a ground surface, the method comprising the steps of:

providing a tee body that includes three sides connected by three apexes to form a generally triangular shape, and further comprising a leg that extends downwardly from each of the apexes of the triangular body to form a ground contact point;

positioning the golf tee on the ground surface such that the tee body is supported above the ground surface upon the ground contact points of the legs;

positioning the golf ball on the tee body such that the golf ball contacts midpoints of each of the three sides without contacting any other parts of the tee body; and striking the golf ball so that it is driven off of the tee body.

* * * * *